United States Patent [19]

Mulroy

[11] 4,291,827

[45] Sep. 29, 1981

[54] CARTON WITH SELF-LOCKING END CLOSURE AND BLANK FOR FORMING SAME

[75] Inventor: Terence J. Mulroy, Sioux City, Iowa

[73] Assignee: Champion International Corporation, Stamford, Conn.

[21] Appl. No.: 126,376

[22] Filed: Mar. 3, 1980

[51] Int. Cl.[3] ..... B65D 5/10

[52] U.S. Cl. ..... 229/39 R

[58] Field of Search ..... 229/39 R, 35

[56] References Cited

U.S. PATENT DOCUMENTS

| | | | |
|---|---|---|---|
| 2,053,857 | 9/1936 | Weiss | 229/39 R |
| 2,151,733 | 3/1939 | Bonfield | 229/39 R |
| 2,361,603 | 10/1944 | Cohen et al. | 229/39 R |
| 2,481,288 | 9/1949 | Cage | 229/39 R |
| 2,649,240 | 8/1953 | Gilbert | 229/39 R |
| 2,955,737 | 10/1960 | Arneson | 229/35 |
| 3,074,613 | 1/1963 | Capo | 229/39 R |
| 3,178,096 | 4/1965 | Reeves et al. | 229/39 R |

*Primary Examiner*—Davis T. Moorhead

*Attorney, Agent, or Firm*—Evelyn M. Sommer

[57] ABSTRACT

A carton and a blank for forming same has self-locking end closure flaps which are hingedly coupled to adjacent end edges of the side walls of the carton. Each flap of one pair of opposed end closure flaps has two elongated slots oriented at acute angles relative to the fold line between the respective panel and flap. Each flap of the other pair of opposed end closure flaps has angular side edges oriented at acute angles relative to the fold line between the respective panel and flap and a pair of tabs extending from those angular side edges. When fully assembled, the tabs are received in respective slots and overlie interior surfaces of the one pair of end closure flaps.

11 Claims, 5 Drawing Figures

CARTON WITH SELF-LOCKING END CLOSURE AND BLANK FOR FORMING SAME

BACKGROUND OF THE INVENTION

The present invention relates to a carton with a self-locking end closure and a blank for forming the carton. More particularly, the invention relates to a collapsible self-locking end closure structure which permits shipment of the partially assembled carton in a flat, collapsed configuration, while permitting complete assembly and set up by a simple manual operation without the use of glue.

In constructing cartons or containers for such articles as meat, and fresh fruits and vegetables, it is necessary to provide a strong bottom closure arrangement. The bottom closure arrangement must be strong to support the considerable weight of the contents.

Since the carton mnufacturer may be located far from where the commodities are packed, the carton must be capable of being shipped in a flat, collapsed configuration to use shipping and storage space efficiently. Otherwise, the carton would waste considerable space and prevent economical shipment.

Once at the packing location, the partially assembled carton must be constructed for full assembly easily without skilled personnel or complex machinery. Thus, the action necessary to convert the carton from its partially assembled, collapsed configuration to its fully assembled state must be extremely quick and simple.

SUMMARY OF THE INVENTION

Accordingly, it is an object of the present invention to provide a carton and a blank for forming a carton with a self-locking end closure arrangement which is collapsible so that the carton may be shipped in a flat, partially assembled, collapsed configuration.

Another object of the present invention is to provide a carton and a blank for forming a carton with a self-locking end closure arrangement that may be quickly and simply converted from a partially assembled, collapsed configuration to a fully assembled configuration without skilled personnel and without complex folding and gluing machinery.

An additional object of the present invention is to provide a carton and a unitary blank for forming a carton of rugged construction which is simple and inexpensive to manufacture, assemble and use.

The foregoing objects are attained by providing a carton with a self-locking end closure, comprising four wall panels coupled at adjacent side edges thereof, and self-locking end closure means comprising first, second, third and fourth end closure flaps each hingedly coupled to one of the wall panels at adjacent end edges thereof along fold lines, each flap of one pair of opposed flaps having two elongated slots therein oriented at acute angles relative to the fold line between the respective panel and flap, each flap of the other pair of opposed flaps having angular side edges oriented at acute angles relative to the fold line between the respective panel and flap and a pair of tabs extending from the angular side edges.

The foregoing objects are also attained by providing a planar, unitary blank for forming a carton with a self-locking end closure, comprising a front panel, first and second side panels hingedly coupled to the front panel at opposed side edges thereof along fold lines, a back panel hingedly coupled to the second side panel at a side edge thereof remote from the front panel along a fold line, and first, second, third and fourth end closure flaps hingedly coupled to the first side panel, the front panel, the second side panel and the back panel, respectively, at adjacent end edges thereof along fold lines, each flap of one pair of alternate flaps having two elongated slots therein oriented at acute angles relative to the fold line between the respective panel and flap, each flap of the other pair of alternate flaps having angular side edges oriented at acute angles relative to the fold line between the respective panel and flap and a pair of tabs extending from the angular side edges.

By forming the carton and blank of the present invention in this manner, a carton may be provided which may be partially formed and shipped in a flat, collapsed configuration and then easily and quickly rearranged to a fully assembled configuration in which the end closure of the carton is strong, rugged and self-locking. The self-locking end closure arrangement permits the carton to be finally assembled by a simple manipulation without gluing, complex machinery or skilled personnel. Additionally, this arrangement permits an efficient use of the material used to form the carton. Thus, the present invention permits cartons formed with self-locking end closure arrangements to be easily and economically manufactured, shipped, stored and used.

Other objects, advantages and salient features of the present invention will become apparent from the following detailed description, which taken in conjunction with the annexed drawings, discloses a preferred embodiment of the present invention.

As used in this application, the terms, "first", "second", "third", "fourth", "top", "bottom", "end", "side", "front" and "back", are intended to facilitate the description of the carton and the blank for forming the carton. Thus, such terms are merely illustrative of the carton and blank and are not intended to limit the carton or blank to any specific orientation.

BRIEF DESCRIPTION OF THE DRAWINGS

Referring to the drawings which form a part of this original disclosure.

DETAILED DESCRIPTION OF THE PREFERRED EMBODIMENT OF THE INVENTION

Figure 1:
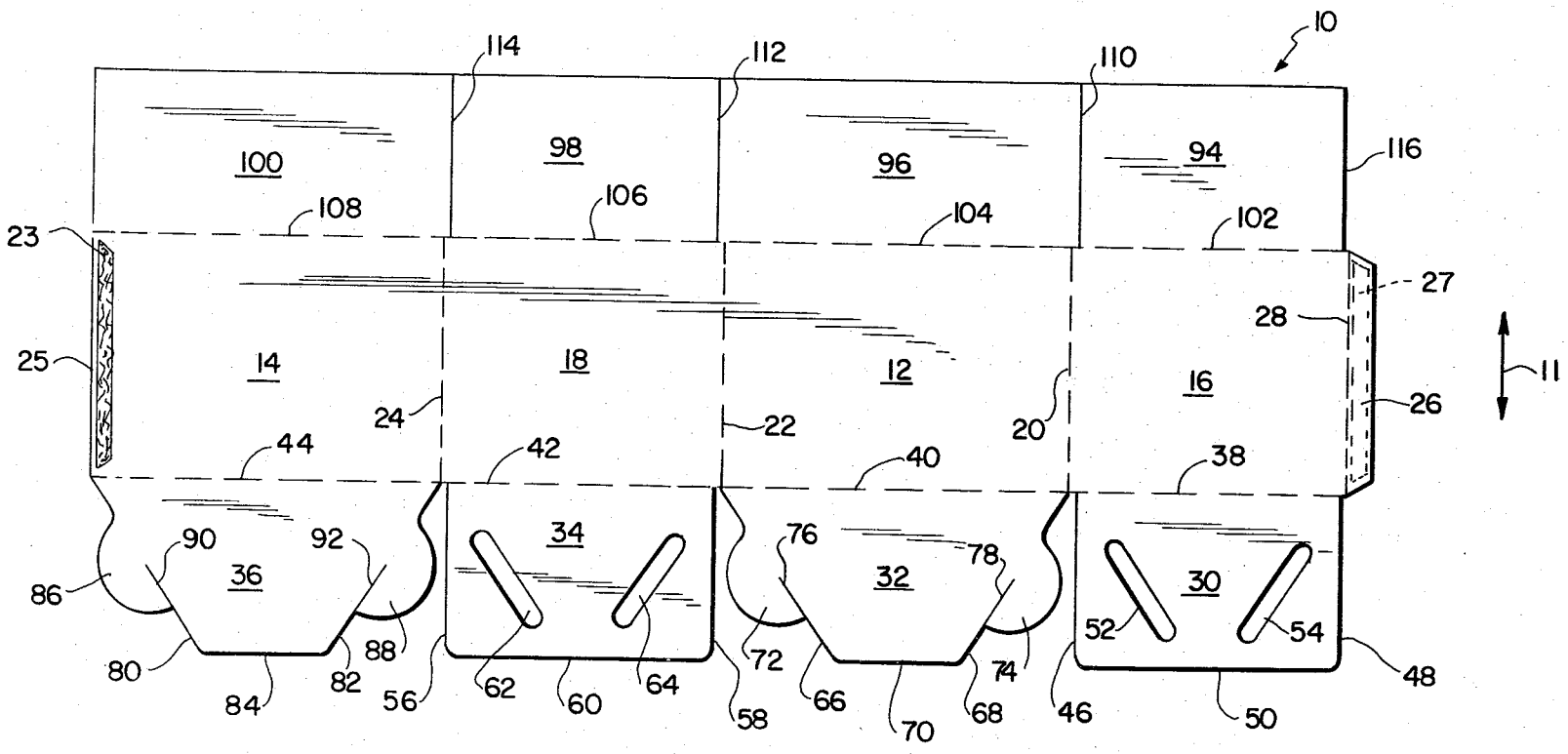
FIG. 1 is a plan view illustrating the interior surface of a blank for forming a carton in accordance with the present invention.

Referring to FIG. 1, the blank 10 may be formed of a unitary piece of paperboard of suitable weight and thickness, preferably corrugated cardboard. The weight and thickness of the cardboard depends on the size and weight of the articles to be contained within the carton. FIG. 1 illustrates the surface of the blank 10 which will form the interior of the carton. Preferably, the corrugations are oriented in directions parallel to the line 11.

The main portion of the blank comprises front and back panels 12, 14 and two side panels 16, 18. Each of these panels is generally rectangular in shape. The first side panel 16 is hingedly coupled to the front panel 12 at one side edge thereof along fold line 20. The second side panel 18 is hingedly coupled to the front panel 12 at the opposite side edge thereof along the fold line 22. The back panel 14 is hingedly coupled to the second side panel 18 at a side edge thereof remote from the front panel 12 along a fold line 24. A glue area 23 is provided on the interior surface of the back panel 14 adjacent the free edge 25.

A trapezoidal glue flap 26 is hingedly coupled at its longer parallel base to a side edge of the first side panel 16 remote from the front panel 12 along a fold line 28. A glue area 27 is provided on the exterior surface of flap 26.

Four bottom end closure flaps 30, 32, 34, 36 are attached to and depend from the panels 16, 12, 18, 14, respectively. The first bottom flap 30 is hingedly coupled to the first side panel 16 at the bottom edge thereof along a fold line 38. The second bottom flap 32 is hingedly coupled to the front panel 12 at a bottom edge thereof along a fold line 40. The third bottom flap 34 is hingedly coupled to the second side panel 18 at the bottom edge thereof along a fold line 42. The fourth bottom flap 36 is hingedly coupled to the back panel 14 at the bottom edge thereof along the fold line 44. The fold lines 38, 40, 42, 44 are adjacent and colinear.

The first and third bottom flaps 30, 34 form a first pair of substantially identical, alternate bottom flaps. The second and fourth bottom flaps 32, 36 form a second pair of substantially identical, alternate bottom flaps.

The first bottom flap 30 is generally rectangular in shape and has side edges 46, 48 and one end edge 50. The other end edge is provided by the fold line 38. The side edges 46, 48 are parallel to the fold lines 20, 28, respectively and are offset slightly (typically $\frac{1}{8}$ inch) inwardly to compensate for the thickness of the blank material during folding. Two elongated slots 52, 54 with rounded longitudinal ends are formed in the first bottom flap 30. The center line of each of the slots 52, 54 are oriented at an acute angle of approximately 45° relative to the fold line 38. The slots 52, 54 approach each other with greater distance from the fold line 38.

Similarly, the third bottom flap 34 is generally rectangular in shape with parallel side edges 56, 58 which are parallel to and offset (typically $\frac{1}{8}$ inch) laterally inwardly from the fold lines 24, 22, respectively. The end edges of the flap 34 are defined by the fold line 42 and the free end edge 60. The flap 34 has two elongated slots 62, 64 with rounded longitudinal ends. The center lines of the slots 62, 64 are oriented at acute angles of approximately 45° relative to the fold line 42 and are angled towards each other with increasing distance from the fold line 42.

The second and fourth bottom flaps 32, 36 are generally in the form of isosceles trapezoids with their longer parallel base oriented along the fold lines 40, 44, respectively. The second bottom flap 32 has angular side edges 66, 68 oriented at acute angles of approximately 45° relative to the fold line 40 and a free end edge 70. Semi-circular tabs 72, 74 extend from the side edges 66, 68, respectively, with the straight line edges of the tabs forming the junctures with the bottom flap 32. Slits 76, 78 extend along the junctures of the tabs 72, 74, respectively, with the flap 32 from the ends of the junctures remote from the line 40 for half the length of each juncture.

Similarly, the fourth bottom flap 36 has angular side edges 80, 82 oriented at acute angles of approximately 45° relative to the fold line 44 and a free end edge 84. Semicircular tabs 86, 88 extend outwardly from the side edges 80, 82, respectively, with the straight line edges of the tabs forming the junctures with the flap 36. Slits 90, 92 are formed along half the length of the juncture between each tab 86, 88, respectively, and the bottom flap 36 from the end of each juncture remote from the fold line 44.

The slots 52, 54 and 62, 64 are spaced at distances from the respective corners of flaps 30, 34 adjacent fold lines 38, 42, respectively, substantially equal to the spacing of tabs 72, 74 and 86, 88 from the respective corners of flaps 32, 36 adjacent fold lines 40, 44, respectively, to permit the respective slots and tabs to mate.

Top flaps 94, 96, 98, 100 extend from and are hingedly coupled to from the top end edges of the panels 16, 12, 18, 14, respectively, along colinear fold lines 102, 104, 106, 108, respectively. These top flaps are generally rectangular in shape. The first top flap 94 is separated from the second top flap 96 by the slit 110. The second top flap 96 is separated from the third top flap 98 by the slit 112. The third top flap 98 is separated from the fourth top flap 100 by the slit 114. The free side edge 116 of the top flap 94 and the slit 110 are slightly and inwardly offset (typically 1/16 inch) and parallel to the fold lines 28, 20, respectively. Similarly, the slits 112, 114 are parallel to and slightly inwardly offset (typically 1/16 inch) relative to the fold lines 22, 24. This offsetting arrangement compensates for the thickness of the paperboard material of the blank in folding.

Figure 3:
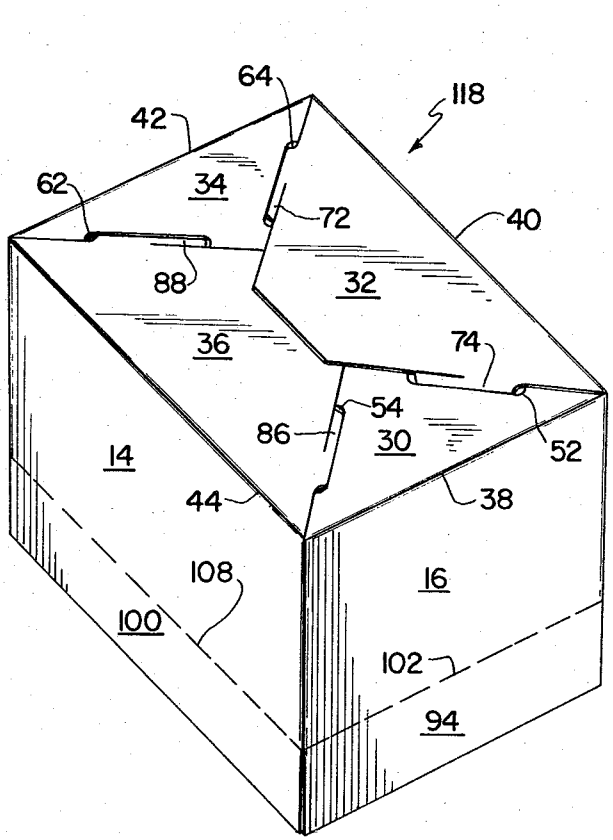
FIGS. 2 and 3 are perspective views illustrating various stages of assembly of the carton formed from the blank of FIG. 1.
Figure 2:
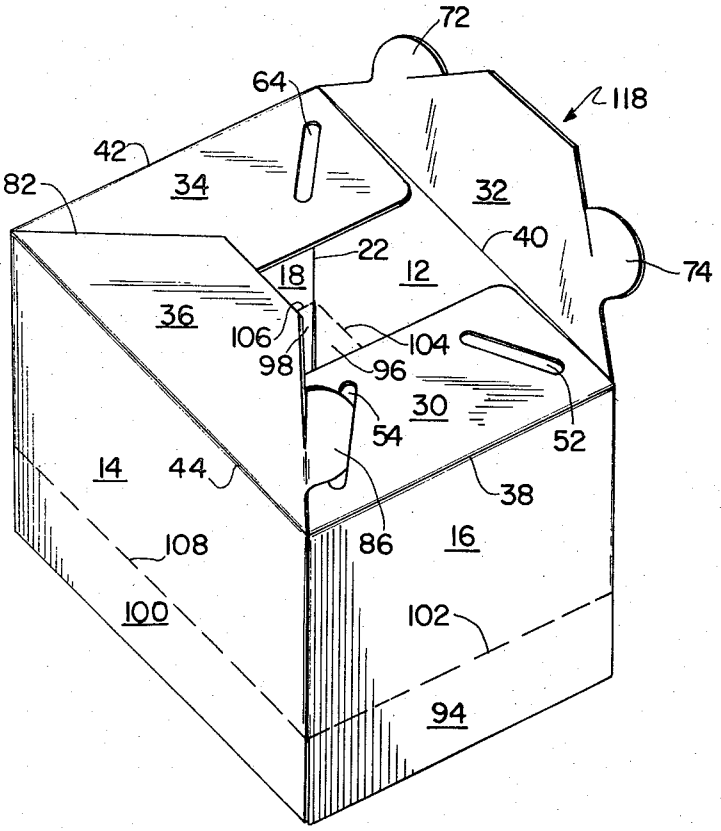
Figure 4:
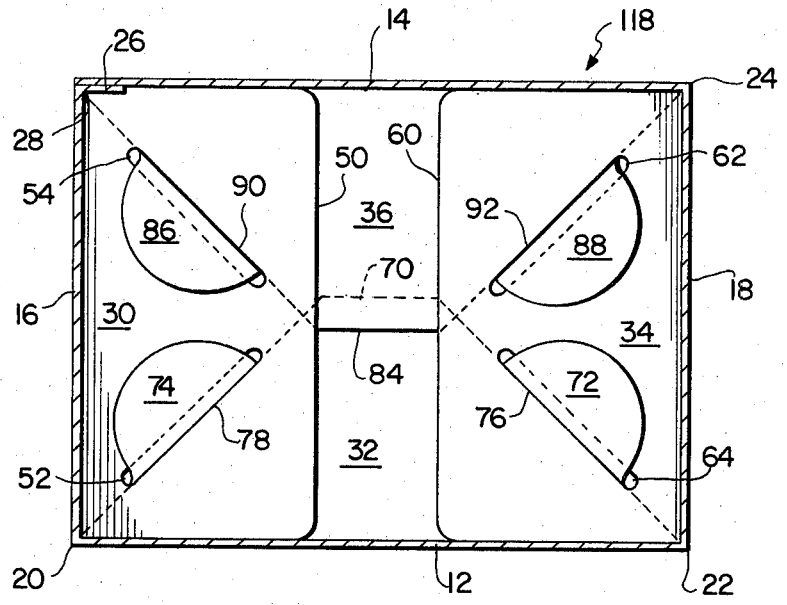
FIG. 4 is a top plan view in cross section illustrating the interior of the carton formed from the blank of FIG. 1.
Figure 5:
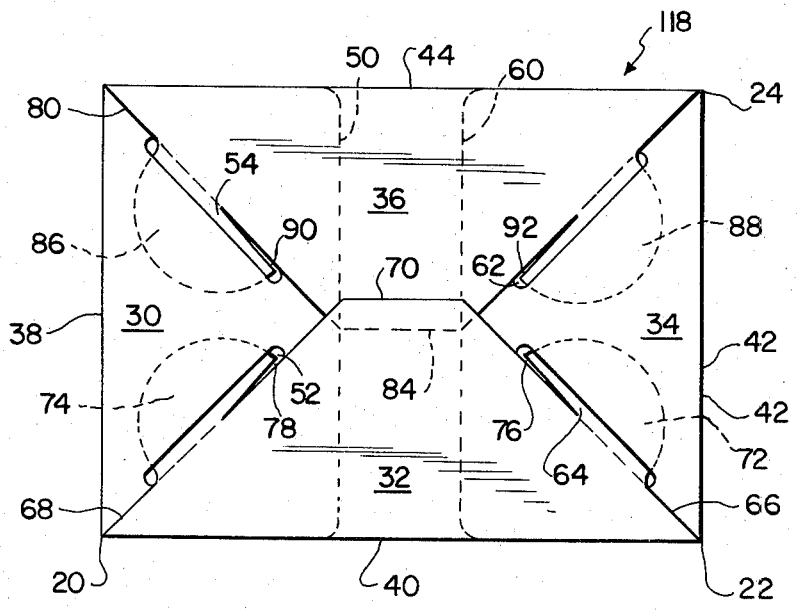
FIG. 5 is a bottom plan view of the carton of FIG. 4.

The assembly of the carton is illustrated in FIGS. 2 and 3, while the assembled carton 118 is illustrated in FIGS. 4 and 5. The carton 118 is formed from the blank 10 by folding the first side panel about fold line 22 until it overlies the interior surface of the front panel 12. The back panel 14 is then folded about the fold line 24 until the back panel overlies the interior surfaces of the second side panel 18 and a portion of the front panel 12 adjacent the fold line 22. In this position, the glue area 23 on the back panel 14 mates with the glue area 27 on the glue flap 26. The adhesive applied to the glue area 23 and/or glue area 27 hingedly couples the first side panel 16 to the back panel 14 along the fold line 28. The top and bottom flaps remain coplanar with their respective panel. These assembly steps are usually performed by the carton manufacturer and form the partially assembled, flat, collapsed configuration of the carton 118. It is in this flat, collapsed configuration that the carton 118 may be shipped, stored and fully assembled simply, inexpensively and efficiently.

Final assembly of the carton 118 is usually performed at the backing location. The fully assembled configuration of the carton is formed by pivoting the panels 16, 12, 18, 14 about the fold lines 28, 20, 22, 24 until the front and back panels 12, 14 are parallel, and the side panels 16, 18 are parallel to each other and perpendicular to the front and back panels 12, 14. In this position, the panels 16, 12, 18, 14 form the side walls of the carton 118. The top and bottom flaps are still coplanar with their respective panels.

Once the panels 16, 12, 18, 14 have been properly oriented relative to one another, the first and third bottom flaps 30, 34 are folded about lines 38, 42, respectively, until flaps 30, 34 are oriented in planes substantially perpendicular to the side panels 16, 18, respectively. Thereafter, the fourth bottom flap 36 may be folded about line 44, while simultaneously causing the tabs 86, 88 to pass through the slots 54, 62, respectively, in the bottom flaps 30, 34, respectively, as illustrated in FIG. 2. When the fourth bottom flap 36 contacts the exterior surfaces of the bottom flaps 30, 34, the edges of the tabs 86, 88 defining the slits 90, 92, respectively, abut and engage adjacent edge portions of the slots 54, 62, respectively, to lock the fourth bottom flap 36 relative to the first and third bottom flaps 30, 34. The second bottom flap 32 is then folded about line 40, while simultaneously causing the tabs 72, 74 to enter the slots 64, 52, respectively, in the bottom flaps 34, 30, respectively, as illustrated in FIG. 3. When the second bottom flap 32 engages the exterior surfaces of the bottom flaps 30, 36, 34, the edges of the tabs 72, 74 defining the slits 76, 78, respectively, abut and engage adjacent edge portions of the slots 64, 52, respectively, to lock all of the bottom flaps in place in a self-locking manner.

Once the bottom flaps 30, 32, 34, 36 have been locked in place as described hereinabove, the carton 118 is ready for packing. The articles placed within the carton 118 further lock the bottom flaps together by applying downward pressure on the tabs 72, 74, 86, 88 to cause the tabs to frictionally engage the interior surfaces of the first and third bottom flaps 30, 34 and to ensure that the edges of the tabs at the slits thereof remain in engagement with the edge portions of the slots in the first and third bottom flaps 30, 34.

Once the packing of the carton 118 has been completed, the carton may be closed and sealed by pivoting the top flaps 94, 96, 98, 100 about fold lines 102, 104, 106, 108, respectively, and sealing those flaps closed in any appropriate conventional manner. At this stage, the carton 118 and the contents therein are ready for shipment and storage.

If desired, the carton 118 may be again arranged in its flat, collapsed configuration after it has been emptied by pivoting the second bottom flap 32 about line 40, while removing the tabs 72, 74 from the slots 64, 52, respectively. Thereafter, the fourth bottom flap 36 is folded about line 44, while simultaneously removing the tabs 86, 88 from the slots 54, 62, respectively. This unlocks the bottom flaps so that each bottom flap may be pivoted to a position in which it is coplanar with its respective panel to permit the carton 118 to be collapsed to its flat configuration. In this position, the carton may be stored and shipped for reuse, or disposal.

The carton can be made either with the second and fourth bottom flaps 32, 36 overlapping, as illustrated in FIGS. 2 and 3, or with the end edges 70, 84 thereof abutting. In either case, in a typical carton, the front panel 12 is $16\frac{5}{8}$ inches wide, the side panels 16, 18 are each 10 $\frac{7}{8}$ inches wide, the back panel 14 is 16 9/16 inches wide, and each of these panels is $6\frac{3}{8}$ inches wide. The glue flap 26 is $1\frac{1}{4}$ inches wide. The top flaps 94, 96, 98, 100 are each 5 7/16 inches wide. The slots 52, 54, 62, 64 are $\frac{1}{2}$ inch wide with the center lines thereof offset $\frac{1}{8}$ inch toward the fold lines of their respective panels from the 45° angle lines extending from the junctures of the adjacent side edges of the adjacent bottom flaps 32, 36 and the fold lines 40, 44.

When the bottom flaps 32, 36 are to overlap, the ends of the slots therein adjacent the fold lines 38, 42 are spaced $1\frac{3}{4}$ inches therefrom along the 45° center lines. The slots 52, 54, 62, 64 are $4\frac{7}{8}$ inches long. The tabs 72, 74, 86, 88 have a radius of curvature of $2\frac{1}{4}$ inches with centers located $4\frac{1}{8}$ inches from fold lines 40, 44 along their respective side edges. Each of the bottom flaps are 5 13/16 inches in a direction perpendicular to their respective fold lines.

When there is to be no overlap of the bottom flaps 32, 36 each of the bottom flaps is $5\frac{1}{2}$ inches in a direction perpendicular to its respective fold line. The slots 52, 54, 62, 64 are $4\frac{1}{2}$ inches long with the ends thereof adjacent the respective fold lines spaced $1\frac{1}{2}$ inches therefrom along the 45° center lines. The tabs 72, 74, 86, 88 have a radius of $5\frac{1}{8}$ inches with centers spaced $3\frac{7}{8}$ inches along the respective side edges from the respective fold lines.

By forming the carton 118 and blank 10 in this manner, the carton 118 may be shipped and stored in a substantially flat, collapsed configuration. The flat, collapsed carton may then be quickly and simply formed into a fully assembled configuration by a manual operation in which the bottom end closure flaps of the carton 118 lock themselves into position. Thus, when the packer of the carton receives the carton in its collapsed configuration, the carton may be simply and quickly assembled without gluing, complex machinery or skilled personnel.

The self-locking end closure arrangement provided by the arrangement of the present invention securely locks the carton closed to prevent opening thereof and subsequent damage to the contents.

While a particular embodiment has been chosen to illustrate the invention, it will be understood by those skilled in this art that various changes and modifications can be made therein without departing from the scope of the invention as defined in the appended claims.

What is claimed is:

1. A carton with a self-locking end closure, comprising:

four wall panels coupled at adjacent side edges thereof; and self-locking end closure means comprising first, second, third and fourth end closure flaps each hingedly coupled to one of said wall panels at adjacent end edges thereof along fold lines, said end closure flaps having outer edges opposite said fold lines, each flap of one pair of opposed flaps having two elongated slots therein oriented at acute angles relative to the fold line between the respective panel and flap, each flap of the other pair of opposed flaps having angular side edges oriented at acute angles relative to the fold line between the respective panel and flap and a pair of tabs extending from said angular side edges, said tabs being spaced inwardly from the outer edges of said other pair of opposed flaps.

2. A carton according to claim 1, wherein said tabs are received in said slots and overlie interior surfaces of said one pair of flaps.

3. A carton according to claim 2, wherein a slit is provided between each said tab and the respective flap which extends along only part of the juncture therebetween and defines an edge of each said tab abutting an edge of the respective slot.

4. A carton according to claim 3, wherein each said slit is substantially half the length of the respective juncture.

5. A carton according to claim 1, wherein said tabs are semicircular.

6. A carton according to claim 1, wherein said other pair of flaps are trapezoidal.

7. A planar, unitary blank for forming a carton with a self-locking end closure, comprising:

a front panel;

first and second side panels hingedly coupled to said front panel at opposed side edges thereof along fold lines;

a back panel hingedly coupled to said second side panel at a side edge thereof remote from said front panel along a fold line; and first, second, third and fourth end closure flaps hingedly coupled to said first side panel, said front panel, said second side panel and said back panel, respectively, at adjacent end edges thereof along fold lines, said end closure flaps having outer edges opposite said fold lines, each flap of one pair of alternate flaps having two elongated slots therein oriented at acute angles relative to the fold line between the respective panel and flap, each flap of the other pair of alternate flaps having angular side edges oriented at acute angles relative to the fold line between the respective panel and flap and a pair of tabs extending from said angular side edges, said tabs being spaced inwardly from the outer edges of said other pair of opposed flaps.

8. A planar, unitary blank according to claim 7, wherein a slit is provided between each said tab and the respective flap which extends along only part of the juncture therebetween.

9. A planar, unitary blank according to claim 8, wherein each said slit is substantially half the length of the respective juncture.

10. A planar, unitary blank according to claim 7, wherein said tabs are semi-circular.

11. A planar, unitary blank according to claim 7, wherein said other pair of flaps are trapezoidal.

* * * * *